United States Patent [19]

Portell

[11] Patent Number: 4,539,728

[45] Date of Patent: Sep. 10, 1985

[54] CARDS

[76] Inventor: Jose E. Portell, Roda de Ter, Barcelona Torrent 4, Spain

[21] Appl. No.: 594,568

[22] Filed: Mar. 28, 1984

[51] Int. Cl.[3] ..... D01G 15/40

[52] U.S. Cl. ..... 19/105; 19/107

[58] Field of Search ..... 19/107, 105

[56] References Cited

U.S. PATENT DOCUMENTS 4,355,439 10/1982 Estebanell ..... 19/107 X

FOREIGN PATENT DOCUMENTS 2065183A 6/1981 United Kingdom .

*Primary Examiner*—Louis K. Rimrodt

*Attorney, Agent, or Firm*—Cushman, Darby & Cushman

[57] ABSTRACT

In a carding apparatus, a precarding area is provided with two lickerin cylinders having a nip area between them in which is disposed a dihedric body having an edge projecting toward the nip between the cylinders which controls the passage and transfers of the fibers from one cylinder to the adjacent cylinder while removing short staple fibers and other impurities from the web; the body is pivotally mounted to provide a clearance between its inner surface and the surface of the second cylinder through which the impurities pass to be discarded from the carding device.

2 Claims, 1 Drawing Figure

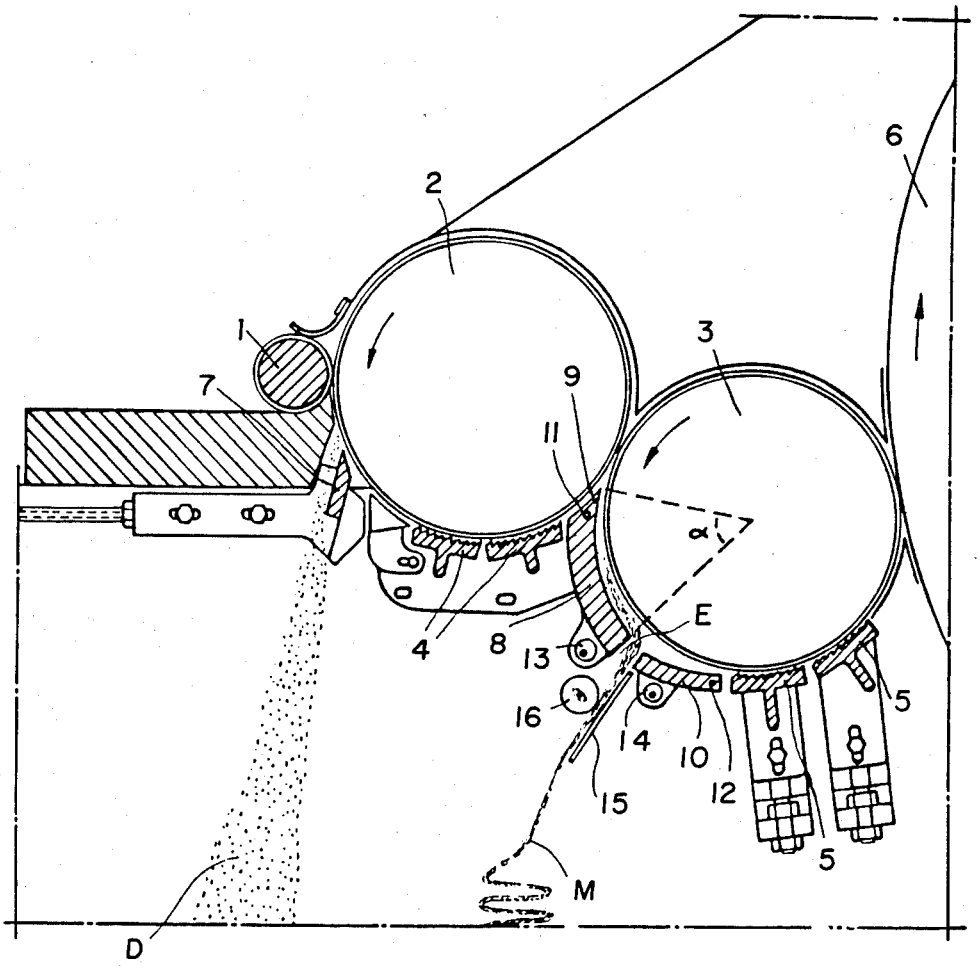
1
2
3
4
5
5
6
7
8
9
10
11
12
13
14
15
16
E
M
D
α

CARDS

The present invention relates to an improvement in carding apparatus and is designed to assist in the removal of the impurities from fibers to be carded and will provide a clean and high-quality web.

In the present operation of carding machines, there are provided pre-carding areas where a cleaning operation is carried out. In such operations, residues of impurities and other materials above a predetermined size which may include granular material, branches, leaves from the cotton plant and the like, all must be removed from the fibers to provide a quality web. However, in the past, cleaning fibers such as cotton was time consuming and difficult which has made it expensive to provide high-quality webs with very few or no impurities. One reason for this deficiency in prior art precarding devices is due to the fact that the fibers are controlled only by an associated knife immediately upstream of the first licker-in cylinder so that the fibers containing the impurities are transmitted and intermingle with the fibers directly, by tangential contact, for one cylinder to an adjacent cylinder.

SUMMARY OF THE INVENTION

According to the present invention, in the precarding area of a carding machine, two cleaning operations are performed, a first one of which is for removing residues of a generally granular nature from the fibers and a second cleaning operation, where the fibers from which the granular material has been removed and comprises generally staple fibers which may still have tiny impurities, is formed into a layer or lap which can be used as a subsequent subproduct. After the second removal of impurities is carried out, a resulting high quality web is attained even in the case where difficult staple cotton fibers containing initially a high degree of residue and impurities is subjected to the apparatus of the present invention. Specifically, the apparatus includes, disposed adjacent the nip between two carding cylinders in a precarding area of the carding machine, an especially shaped dihedric member, the member is formed with a first surface that is concavely arcuate and which faces and is adjacent to a portion to a surface of a first cleaning cylinder. The dihedric members formed with a second concavely arcuate surface which faces and is adjacent to a portion of a surface of a second cleaning cylinder. One end of the member is spaced from another member contiguous to the periphery of the second cylinder to provide a discharge clearance for the impurities, shorter fibers and plant debris separated from the longer staple fibers by the second cylinder with the aid of air currents originating with the rotating cylinder.

The ejected material impacts against a specially shaped arcuate plate located adjacent the discharged clearance. The dihedric member and arcuate plate are pivotally mounted each about a respective end for movement toward or away from the periphery of the second cylinder and to adjust a clearance between these members. The air currents coming into contact with these surfaces assist in removing the short fibers and inpurities which may constitute a lap or something similar thereto.

The foregoing and other advantages of the present invention with reference to the accompanying drawings, in which:

BRIEF DESCRIPTION OF THE DRAWING

The only FIGURE is a schematic, elevational partially sectional view of the precarding area of a card incorporating the improvements of the present invention.

DETAILED DESCRIPTION OF THE INVENTION

According to the present invention, the precarding area includes a feed roller 1 after which there are located two licker-in cylinders 2 and 3 including plates located below and adjustably mounted such as 4 and 5. The plates are provided with suitable surface covering material. Following the cylinder 3, there is disposed the main cylinder 6.

Between the feeding roller 1 and the licker-in cylinder 2, there is disposed an adjustable knife 7 which carries out the first residue removal operation, generally of a granular nature indicated at D. Some elements of the cotton plant also are removed at this stage.

Between the two licker-in cylinders 2 and 3, there is disposed the device of the present invention, namely the knife edge 8 having an asymmetrical profile or body which, in this case is of quadrangular section showing a dihedron 9 formed by two concave sides or surfaces curvatures of the respective sides being appropriate to the periphery of the immediately adjacent facing cylinder 2 or 3.

The edge of the dihedron serves to set up a control pattern whereby short staple fibers are selected and any remaining granular components or cotton plant debris are removed as well as many other types of small impurities. The material extracted from the main web forms a layer or lap M which is of substantially uniform thickness which is detached and delivered from the licker-in cylinder 3 through a 5 to 40 mm adjustable clearance E which is said by adjusting the pivotal position of the asymmetrical member 8 as well as that of the specially shaped arcuate plate 10 immediately downstream thereof.

The segment angle $\alpha$ illustrated in the drawing which subtends the face of the asymmetrical member 8 which faces the surface of the licker-in cylinder 3 to lie within the range of 15° to 80° relative to the level position of the two licker-in cylinders and taking into account the type of materials to be carded such as recovery of short staple fibers, medium cotton (American type) long cotton (Jumel type), or synthetic fibers of up to 60 mm.

Short staple fibers and impurities are extracted by driving air caused by the rotation at the licker-in cylinder 3 this air being metered by adjusting, stepwise, the clearance E, member 8 and plate 10, the latter being pivoted about eccentric members 13 and 14 about shafts 11 and 12, respectively relative to the cylinder 3 which enables the fibers to stand out from the licker-in surface and effectively remove impurities still being carried along.

The eccentric members 13 and 14 will define the angular shift of the member 8 and plate 10 and may be interlocked by control mechanisms including shafts extending external to the frame of the machine.

The debris of removal of residues and impurities extracted can thus be controlled in steps to reach a satisfactory quality of the final web in the card delivery as fibers entirely free from impurities may be passed to the cylinder 6 to the licker-in cylinder.

The device facilities delivery of lap M close to plate 10 by means of a tray 15 from which a compacting cylinder 16 can be operated to contain a desired degree of density in the lap M.

It will thus be understood that the member 8 and plate 10 can be arranged between other cylinders making up the carding area, for instance, between the second licker-in cylinder 2 and the cylinder 3.

The profile member 8 and plate 10 can also be independently installed or else form a part of any component of the carding machine itself as for instance to be integrated into the screen provided under the first licker-in clinder and controlling residue removal or, for example, as part of the surface plates 4 and/or 5.

Having described the invention, it will be apparent that modifications may be made thereto without departing from the spirit and scope of this invention as defined in the appended claims.

I claim:

1. In a carding machine of the type having, in a precarding area, first and second pivotally mounted cylinders having parallel but spaced apart axes of rotation defining between them a nip, said precarding area having a first means for effecting a first removal of impurities of a generally granular nature, said first means being associated with said first cylinder, the improvement comprising, a member having two concave surfaces, each extending from a common edge, said member being disposed in said precarding area with said edge being adjacent to said nip of said cylinders, one of said concave surfaces facing said first cylinder and the other of said surfaces facing said second cylinder, said cylinders being disposed in said precarding area so that said first cylinder receives fibers to be carded before said second cylinder and so that the fibers in passing from said first cylinder to said second cylinder, pass over said edge of said member, arcuate plate means located downstream of said member and spaced therefrom on the periphery of said second cylinder to define a clearance between said member and said plate means, said member and said plate means being each pivotally mounted remote from said clearance and each having adjustment means for affecting pivoting thereof towards and away from said second cylinder and corresponding adjustment of the size of said clearance whereby a second removal of impurities through said clearance is effected.

2. The invention as claimed in claim 1 wherein adjacent said clearance, tray means is provided which receives the impurities discharged from said clearance and a compacting cylinder is disposed to contact the discharged impurities between said cylinder and said tray means.

* * * * *